US007465695B2

(12) United States Patent
Tischer et al.

(10) Patent No.: US 7,465,695 B2
(45) Date of Patent: Dec. 16, 2008

(54) METHOD OF MANUFACTURING A PRINTED TEXTILE RIBBON

(75) Inventors: Heinz Tischer, Bochum (DE); Rolf Augst, Wuppertal (DE)

(73) Assignee: Avery Dennison Rinke GmbH, Sprockhovel (DE)

( * ) Notice: Subject to any disclaimer, the term of this patent is extended or adjusted under 35 U.S.C. 154(b) by 407 days.

(21) Appl. No.: 11/112,873

(22) Filed: Apr. 23, 2005

(65) Prior Publication Data

US 2005/0264642 A1 Dec. 1, 2005

(30) Foreign Application Priority Data

Apr. 30, 2004 (DE) ..... 10 2004 021 499

(51) Int. Cl.
*B41M 5/035* (2006.01)

(52) U.S. Cl. ..... 503/227; 8/471

(58) Field of Classification Search ..... None
See application file for complete search history.

(56) References Cited

U.S. PATENT DOCUMENTS 4,640,191 A 2/1987 Bradley
2004/0058121 A1 3/2004 Schriefer et al.

FOREIGN PATENT DOCUMENTS

| | | |
|---|---|---|
| DE | 78 27 418 | 9/1978 |
| DE | 91 09 761 | 12/1992 |
| DE | 203 14 291 | 12/2003 |
| EP | 0546 485 A1 | 6/1993 |
| GB | 1 492 313 | 11/1977 |
| WO | 98/03724 | 1/1998 |

OTHER PUBLICATIONS

Patent Abstracts of Japan, No. 06313261 A, Nov. 8, 1994.
Patent Abstracts of Japan, No. 05148755 A, Jun. 15, 1993.

*Primary Examiner*—Bruce H Hess
(74) *Attorney, Agent, or Firm*—Christie, Parker & Hale, LLP.

(57) ABSTRACT

A method of manufacturing printed textile ribbons reliably and inexpensively, initially a web is produced which forms the later ribbon. The web is composed of two different materials, wherein a figure is applied on one side of the web. The web is subsequently subjected to a heat and pressure treatment with sublimation colors, such that the sublimation colors are absorbed by the first ribbon material and produce on one side a desired printed image. The figure is composed on this side of materials which do not absorb the sublimation colors. As a result, the color of the figure remains unchanged on this side of the ribbon, although the figure had contact with the sublimation colors.

17 Claims, 5 Drawing Sheets

METHOD OF MANUFACTURING A PRINTED TEXTILE RIBBON

BACKGROUND OF THE INVENTION

1. Field of the Invention

The present invention relates to a method of manufacturing a printed textile ribbon which includes applying at least on one side of the ribbon a printed image having at least one or more colors, and simultaneously producing on the one side of the ribbon a figure in a color which deviates from the color of the printed image.

2. Description of the Related Art

Textile ribbons are frequently attached and sold together with a textile product. The purpose of such a ribbon may be decorative, it may serve as a reflector or as an advertisement carrier, or may also be an integral component of a product, for example, a brassiere strap. It also happens that textile ribbons are sold by themselves, for example, as key ribbons. In many of these types of applications, it is important that the ribbon has an appearance which is as attractive as possible. The purpose is to increase the sales of the product to which the ribbon is attached. Therefore, it is also important to frequently update and change the appearance of the ribbon.

As compared to manufacturing a multicolor ribbon by weaving, the manufacture of a printed ribbon is particularly fast and inexpensive. Graphic or alphanumeric representations appear on at least one side of the ribbon in at least one color, or frequently also several colors which in the following shall be referred to as "printed image."

In some types of applications it is important that a "figure" is simultaneously formed in a color which deviates from that of the printed image. Such a figure usually is an alphanumeric text which provides information concerning the product, the manufacturer, the distributor, and/or the use of the product, which contains advertising statements, or serves decorative purposes. In some applications there are ribbons with coinciding printed images, which, however, have figures which differ from each other. It is difficult to produce for each of these ribbons a separate printed image with the corresponding figure. Therefore, it has frequently been necessary to completely omit such a figure having a different color in the printed image, and to accept the resulting disadvantages.

SUMMARY OF THE INVENTION

Therefore, it is the object of the present invention to develop a method of the above-described type which makes possible a precise manufacture of a textile ribbon with different printed images and figures in an inexpensive manner.

In accordance with the present invention, a web which later forms the ribbon with the desired figure is manufactured from two different materials, wherein a first ribbon material which is capable of connecting to sublimation colors extends over all surface areas of the one side of the ribbon in which the printed image is to appear with the exception of the figure, and wherein a second ribbon material is provided in the area of the figure, wherein the second ribbon material does not or insufficiently absorbs the sublimation colors. The printed image without the figure produced by a digital printing technology by means of sublimation colors is pressed and heated against the ribbon in such a way that the sublimation colors are absorbed by the receptive areas on the one side of the ribbon formed of the first strip material and the printed image is produced in these areas. The materials in the area of the figure which are formed of the second strip material and do not interact with the sublimation colors come into contact with the sublimation colors but do not accept the sublimation colors, so that the color of the figure on the ribbon remains unchanged.

The desired printed image can be very quickly and inexpensively manufactured in many different colors by means of digital printing technology using sublimation colors with the aid of a suitable computer. The special aspect of the invention resides in that this printing technology is applied to textile ribbons which are normally manufactured in various arrangements on a web. Using a digital printing technology, the printed image is pressed without the figure against the web and is heated. The sublimation colors are then transferred onto the web so that the desired printed image for the ribbon is produced. The special aspect of the present invention is the fact that this digital printing technology is used in connection with the manufacture of textile ribbons.

The method is advantageously carried out in the following special manner if, as mentioned above, a figure is to appear on one side of the ribbon in addition to the printed image. In that case, during the first phase of the method, the figure is not absorbed into the printed image, so that the printed image without the figure also extends over that area in which later the figure is to appear. The actual figure is directly incorporated into the ribbon during the parallel method phase. For this purpose, two different materials are used for the manufacture of the ribbon, wherein the two ribbon materials have a different affinity relative to the sublimation colors of the printing technology. The figure is manufactured in the ribbon from a ribbon material which does not accept the sublimation colors of the printing technology. The figure is manufactured in the ribbon from a ribbon material which does not accept the sublimation colors of the digital printing technology. A surprising effect occurs during the later method phase in which the ribbon is subjected to the above-described treatment by pressure and heat: the figure formed of a separate ribbon material does not accept the sublimation colors; rather, its color remains unchanged while the remaining areas of the ribbon accept and fix the printed image.

This is even true if, in accordance with another feature of the present invention, during the manufacture of the ribbon the figure is formed relief-like on one side of the ribbon. The figure relief does not accept the sublimation colors of the printed image; rather, the relief conducts the colors to adjacent areas of the ribbon which are composed of a ribbon material which has a good affinity to the sublimation colors. The design and the manufacture of the printed image during the first method stage does not have to take into consideration the shape and position of the figure in the later ribbon. By using ribbons with different figures, the same printed image can be reliably and precisely produced as desired with different figures.

In accordance with a special embodiment, the printed image is applied in a mirror-inverted configuration on an intermediate carrier. This intermediate carrier is then pressed with its side containing the sublimation colors onto the web which will later form the ribbon and is also heated during this step. The sublimation colors are then transferred onto the web with whose ribbon material they are connected and are separated from the intermediate carrier.

Depending on the purpose of the finished ribbon, the first ribbon material and/or the second ribbon material may be an elastic material. Also, as desired, one or both of the materials may be inelastic. Consequently, this results in a wide spectrum of applications for the method.

The various features of novelty, which characterize the invention, are pointed out with particularity in the claims annexed to and forming part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE INVENTION

Figure 1:
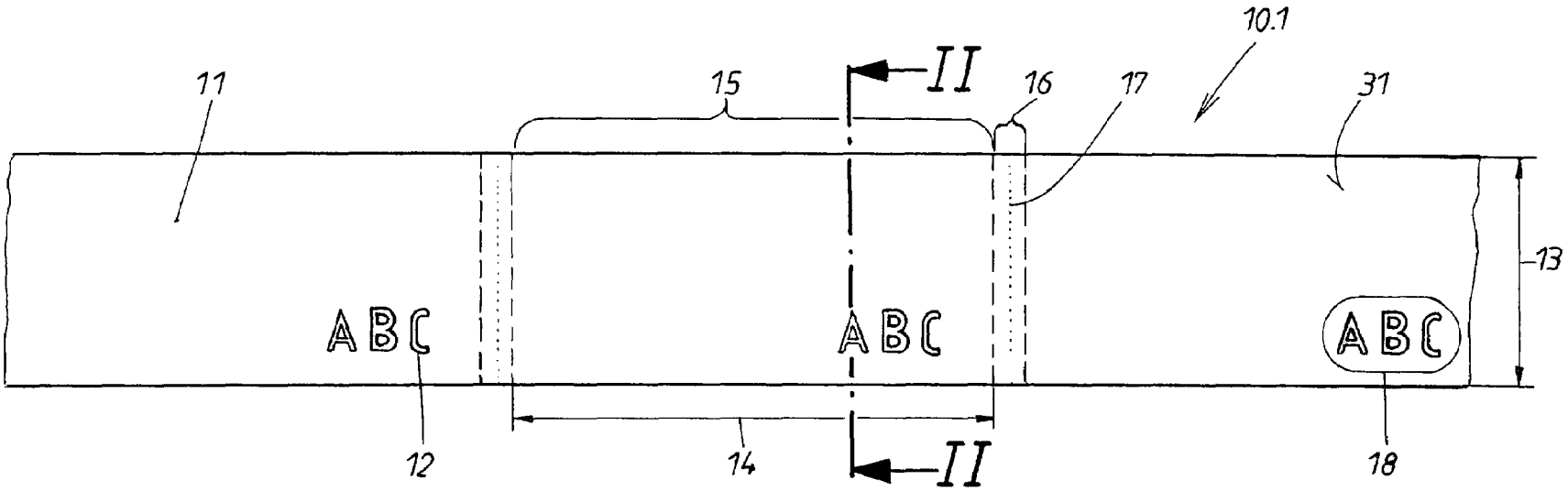
FIG. 1 is a top view of a portion of a woven web which is manufactured in a first method stage of the method according to the present invention, wherein the illustrated ribbon is a label ribbon.

As already mentioned above, the first method stage of the method according to the present invention will be explained in more detail with the aid of FIG. 1. Initially a web 10.1 is produced which later is to form the ribbon 10. In the illustrated embodiment, the web 10.1 is composed of a woven ribbon which already has the desired ribbon width 13. It is understood that a multi-component web 10.1 can be produced which extends over several ribbons widths, wherein, after the last method stage, individual ribbons 10.1' to 10.1"" can be produced on the web 10.1 in the manner which will be described in more detail. If, as is the case in the illustrated embodiment, a label ribbon 10.2 is to be manufactured from the web 10.1, the web width 13 advantageously is already the label width.

Figure 3:
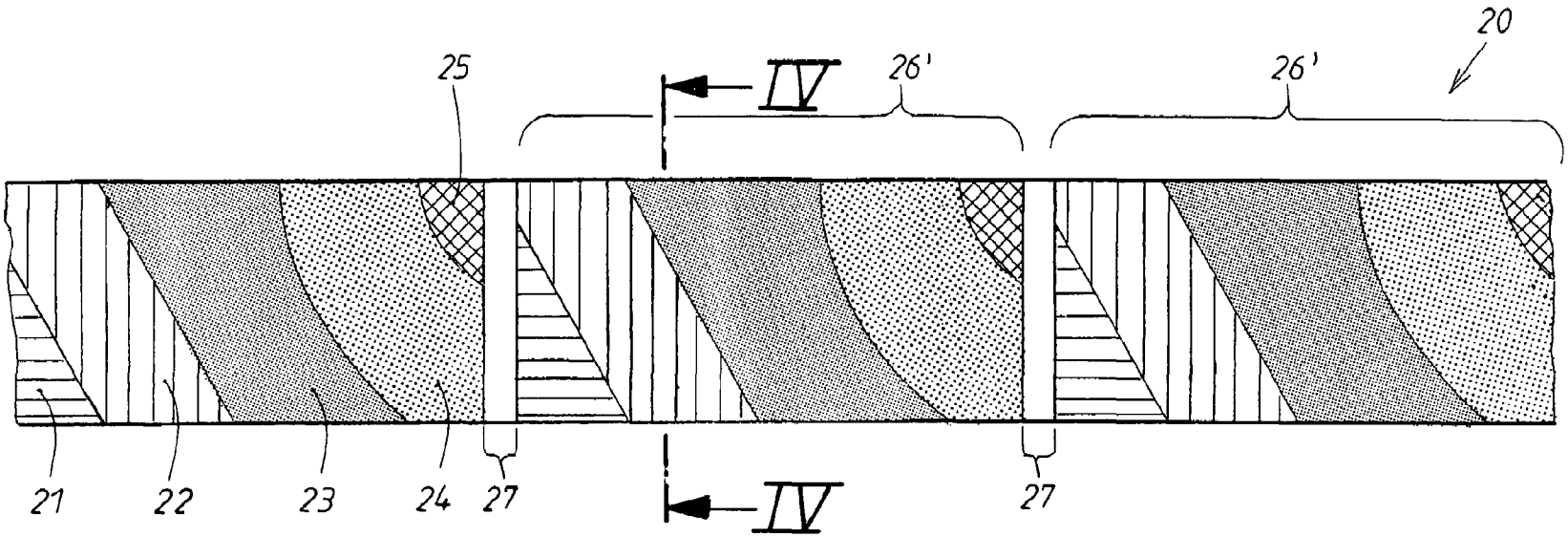
FIG. 3 is a top view showing a parallel further method step in which an intermediate carrier has been provided by means of digital technology with a printed image for printing on the ribbon shown in FIG. 1.
Figure 5:
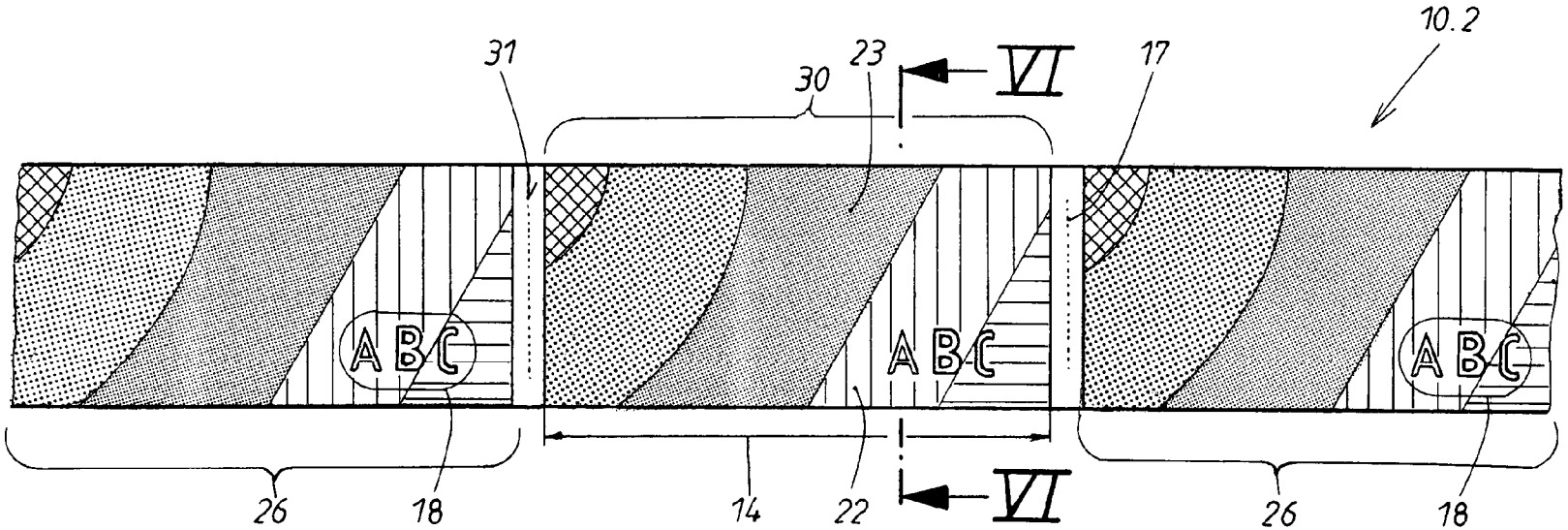
FIG. 5 is a top view showing the appearance of a finished product, namely a label ribbon, which is obtained after an additional method step which is not illustrated in detail, wherein three successive labels are shown.

The web 10.1 is manufactured by weaving from two different ribbon materials 11, 12. The first ribbon material 11, whose properties shall be described in more detail in connection with FIG. 3, is composed, as is conventional in fabrics, of ground warp threads and ground weft threads which produce a unitary ground fabric 15. A plurality of weft threads can be used in the ground fabric fifteen in order to produce in this area the fabric thickness which is later desired for the ribbon. The ground fabric 15 extends in portions of the label ribbon blank illustrated in the drawing over a length 14 which is equal to that of a finished label 30 shown in FIG. 5. As illustrated in FIG. 1, transitions 16 are provided between successive label lengths 14, wherein the transitions 16 have a smaller thickness and may be provided with markings 17 for later separating cuts between the individual labels 30, as seen in FIG. 5. It is sufficient to emphasize these markings 17 by means of weaving technology over the character of the ground fabric 15. The thin transitions 16 can be produced in a simple manner by not inserting all wefts which contribute to the composition of the ground fabric 15. The entire web 10.1 preferably has the color "white" or another light appearance.

Areas of the web 10.1 are composed of a second ribbon material 12 whose composition will also be described in more detail in connection with FIG. 3. This second ribbon material 12 preferably forms in each of the ground fabric carriers 15 a graphic or alphanumeric illustration which in the following will generally be called "figure" and is denoted by reference numeral 18. In the illustrated case, the FIG. 18 is composed of the letters "ABC." This figure is formed by a uniform figure weft 12 in the ground fabric. Instead of a figure weft, it is also possible to use, either additionally or alternatively, a figure warp. The warps 12 of the FIG. 18 have the same color as the ground fabric 15, namely, preferably white or another light appearance.

Figure 2:
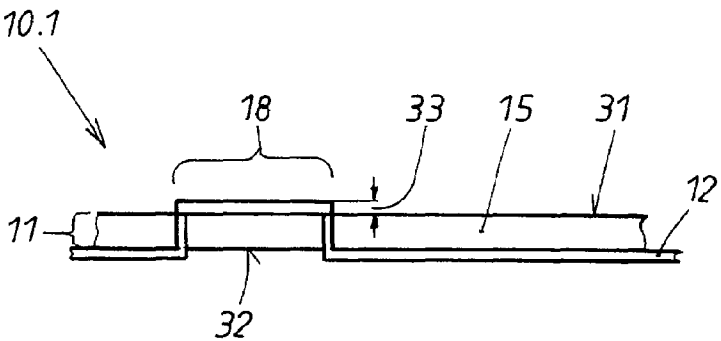
FIG. 2 is a sectional view, on a larger scale, taken through a portion of the ribbon along sectional line II-II of FIG. 1.

The enlarged illustration of FIG. 2 provides a better view of the configuration of the FIG. 18. FIG. 2 shows the figure weft 12 only schematically without illustrating its actual connection to the ground fabric 15. The important aspect is the following: in the area of the FIG. 18, the figure weft 12 is introduced in such a way that the FIG. 18 is raised in the manner of a relief on the one side 31 of the web 10.1 shown in FIG. 2. This results in the relief denoted in FIG. 2 by reference numeral 33. On the other side 32 of the web 10.1, the figure weft insertions 12 only extend in the areas adjacent to FIG. 18, i.e., in the direction of the ribbon width. Accordingly, underneath the FIG. 18, the other side of the ribbon is free of figure weft material 12; the figure weft material 12 is in this area entirely found in the relief 33 on the one side 31.

Figure 4:
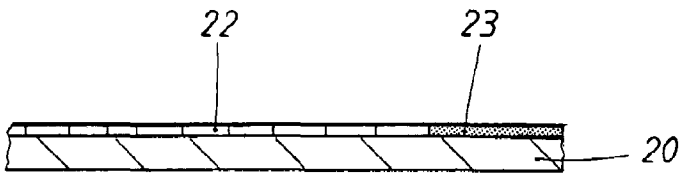
FIG. 4 is a schematic cross-sectional view, on an even larger scale along sectional line IV-IV of FIG. 3.

In accordance with a preferred embodiment, a digital printed image 26' is continuously produced in a parallel method step by means of sublimation colors on an intermediate carrier 20 which is composed, for example, simply of paper. The printed image 26' is produced by means of a computer-controlled digital printing technology in several colors 21 to 25. The composition of the printed intermediate carrier 12 is visible in the partial sectional view of FIG. 4. As is apparent from a comparison of the printed image 26' and the printed image 26 seen on the later label ribbon 10.2 of FIG. 5, the printed image 26' on the side of the carrier is mirror-inverted. The printed image 26' on the carrier 20 extends continuously and also in those areas which have in the finished label 30 the FIG. 18 which has been explained in connection with the web 10.1 and which appears in the finished label 30 of the label ribbon 10.2 as seen in FIG. 5.

Figure 6:
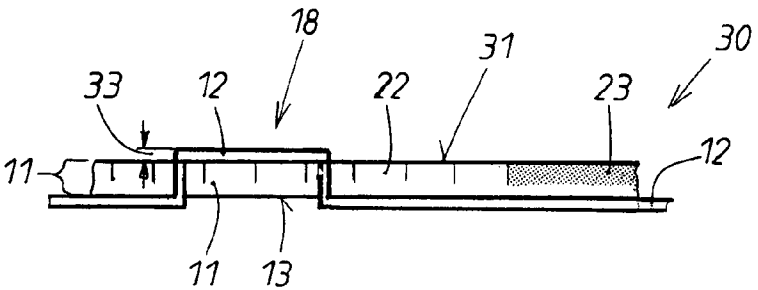
FIG. 6 is a schematic cross-sectional view of a portion of a label, on a larger scale, taken along sectional line VI-VI of FIG. 5.

The two initial products 10.1 and 20 are now subjected to a common pressure and heat treatment. The fabric web 10.1 and the printed intermediate carrier 20 are placed on top of one another and travel through pressure rollers, at least one of which is heated to a defined higher temperature. Heating has the result that the sublimation colors 21 to 25 of the printed image 26' sublime and penetrate into the fabric of the web 10.1. When printing on a label ribbon 10.2, it is only necessary to observe that the gaps 27 between the printed image 26' on the carrier side are essentially located on top of the free transitions 16 between the sections 15 of the label ground fabric 15. However, the subliming colors 21 to 25 are only absorbed by the above-mentioned first ribbon material 11 in the label ground fabric 15 because these colors 21 to 25 react with the ribbon material 11. On the other hand, the second ribbon material 12 of the fabric web 10.1, of which the FIG. 18 is formed on the one side 31, does not absorb the sublimation colors 21 to 25, even though the FIG. 18 comes into contact with the sublimation colors during the pressure and heat treatment. The color of the FIG. 18 remains unchanged on the one side 31. The result is illustrated in FIGS. 5 and 6.

As a result of the pressure and heat treatment, the printed image 26' is transferred in a mirror-inverted manner onto the fabric web 10.1, so that the final desired printed image 26 as seen in FIG. 5 is produced on the one side 31. This result can be seen particularly clearly from the schematic, enlarged cross-sectional view of a portion of the label ribbon 10.2 in FIG. 6. The sublimation color 22 was during the pressure and heat treatment not absorbed by the figure weft material 12 of the FIG. 18, but rather appears only on the other side 13 in the ribbon material 11 located underneath the FIG. 18. The figure weft material 12 allows the sublimation colors to penetrate but does not change color itself. However, the FIG. 18 covers the area colored on the other side 32 and, therefore, is not visible from the one side 31. On its one side 31, the FIG. 18 appears in its original color which in the illustrated embodiment is white. The FIG. 18 woven into the fabric protrudes in the form of the already mentioned relief 33 above the one side 31 of the finished label 30.

The figure weft material 12 which does not accept the sublimation colors 21 to 25 is composed of natural fibers or regenerated cellulose fibers. Suitable for this purpose are also viscose or acetate. Such figure threads 12 can also be formed as reflector threads. These threads also do not absorb the sublimation colors 21 to 25.

Figure 7:
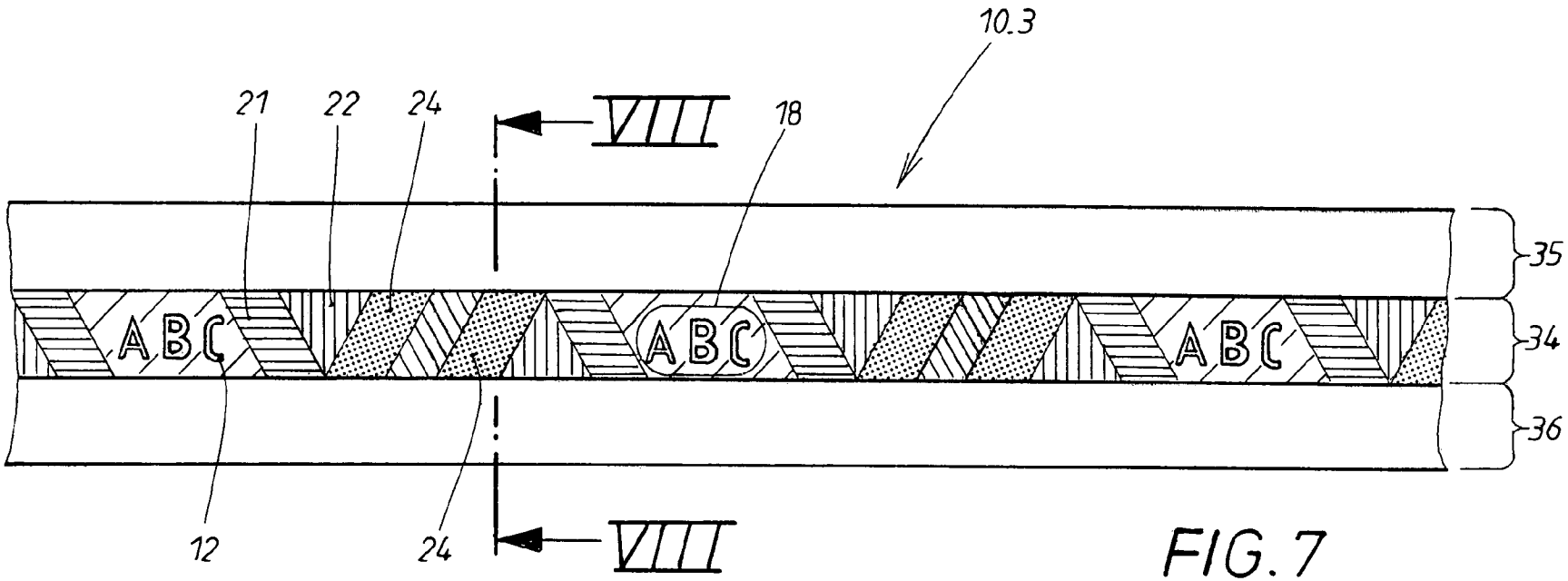
FIG. 7 is a top view of a waistband for trousers or skirts manufactured by the method according to the invention.
Figure 8:
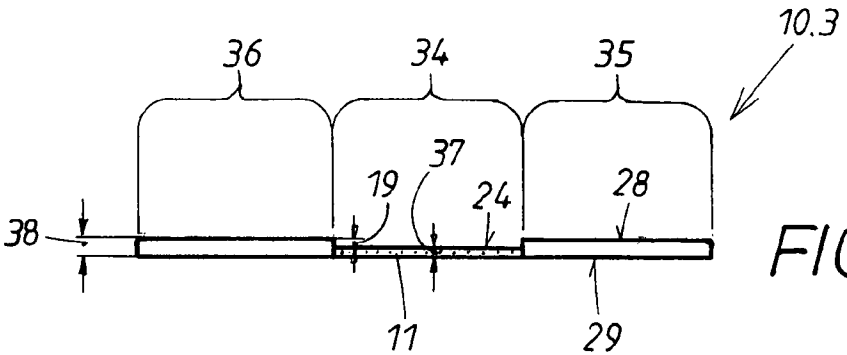
FIG. 8 is a sectional view, on a larger scale, taken along sectional line VIII-VIII of FIG. 7.

FIGS. 7 and 8 of the drawings show another already finished product 10.3 which has been manufactured in accordance with the described method according to the present invention. The finished product is a waistband as it is used in trousers or skirts. As seen in FIG. 8, this waistband 10.3 is manufactured with different thicknesses. The product includes a middle strip with a small width 37 which is surrounded on both longitudinal sides by two edge strips 35, 36 which have a significantly greater thickness 38. While the other side 29 of the ribbon 10.3 is essentially flat, different heights 19 are formed on the other side 28.

In this case, the sublimation colors 21, 22, 24 can also be applied by means of an intermediate carrier. However, in this case, the colors are only transferred onto the middle strip 34 of the waistband 10.3 because the web material 11 absorbing the colors is present in this area. Moreover, FIG. 18 of a strip material 12 can also be formed in the middle strip 34, wherein the ribbon material 12 has no affinity to the sublimation colors. Consequently, these areas do not accept the colors when the method according to the invention is carried out and can also be raised in the manner of a relief or with a lower depth. If desired, the materials of the edge strips 35, 36 may also be formed of materials 12 which repel the sublimation colors 21 to 25.

Figure 9:
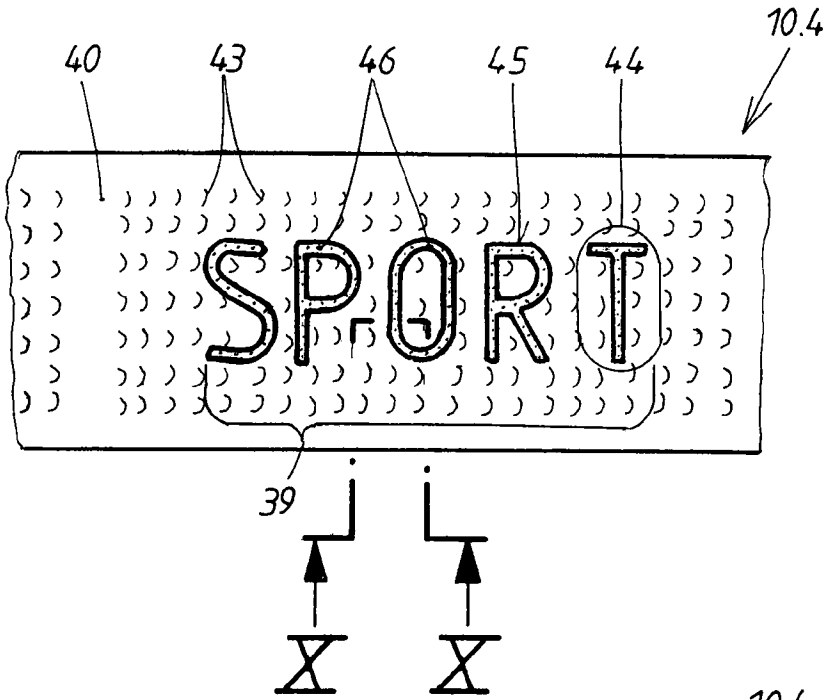
FIG. 9, is a top view of a portion of a Velcro ribbon with areas of pressure absorption.
Figure 10:
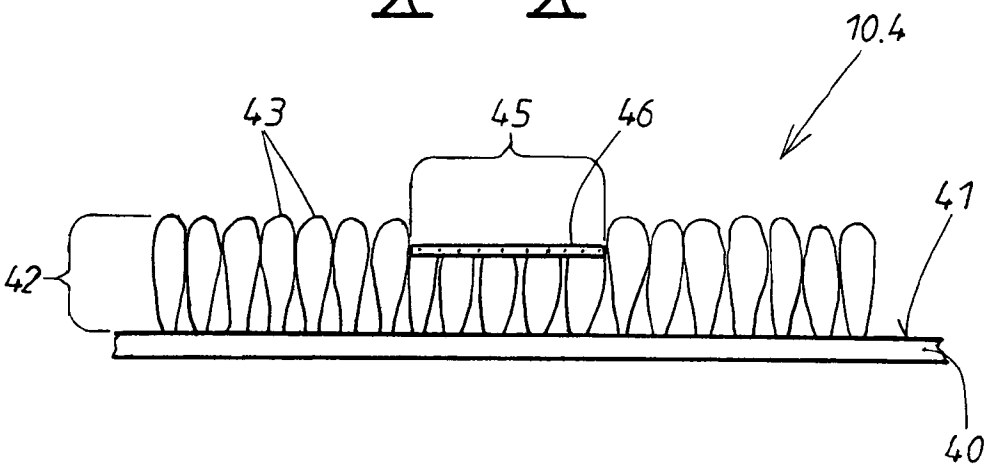
FIG. 10 is a schematic cross-sectional view, on a larger scale, of the Velcro ribbon of FIG. 9 taken along sectional line X-X

FIGS. 9 and 10 show another embodiment of a Velcro closing ribbon which is manufactured according to the method of the present invention. Consequently, FIGS. 9 and 10 show the final product. In this method, a layer 42 of Velcro loops 43 is produced on the visible side 41 of a ground fabric 14. This can be done by weaving. The loop layer 42 is deformed over areas thereof on the visible side. At the deformed areas, flat locations 45 are formed which receive a printed image 46 during the later digital printing process. The flat areas consist of a material which has a good affinity to the sublimation colors which have already been mentioned several times above. After the pressure and heat treatment has been carried out, the printed image 46 appears on these pressure application areas 45. These pressure application areas 45 can be arranged in such a way that, as illustrated in FIG. 9, they are not only provided with the printed image 46 but produce on the velcro closing ribbon 10.4 because of their configuration a word and/or image structure.

The undeformed apex areas of the Velcro layer 42 do not absorb the sublimation colors during the pressure and heat treatment according to the present invention or at least absorbs them substantially less than the above-described pressure receiving locations 45. These locations assume the function of the above-described figure of the ribbon 10.1 and are composed of color-repellent material.

In accordace with another embodiment several individual ribbons are arranged next to each other in such a way that a composite ribbon is formed. This composite ribbon is then subjected to the pressure and heat treatment according to the present invention. The individual ribbons may have different widths and/or different figures and they can also be imprinted with different printed images. Of course, the ribbons may all also be identical and a combination of identical and different ribbons is also possible. As a result of this configuration, it is also possible to simultaneously manufacture different ribbons. This is particularly advantageous if smaller production quantities are produced. After traveling through the pressure and heat treatment the ribbons are once again separated and are then used as intended.

While specific embodiments of the invention have been shown and described in detail to illustrate the inventive principles, it will be understood that the invention may be embodied otherwise without departing from such principles.

We claim:

1. In a method of manufacturing a printed textile ribbon, the method including applying at least on one side of the ribbon a printed image having at least one or more colors, and simultaneously producing on the one side of the ribbon a figure in a color which deviates from the color of the printed image; the improvement comprising manufacturing a web which will later form the ribbon with the desired figure from two different materials, wherein a first ribbon material which is capable of connecting to sublimation colors extends over all surface areas of the one side of the ribbon in which the printed image is to appear with the exception of the figure, while a second ribbon material is provided in that area of the figure which does not absorb or insufficiently absorbs the sublimation colors; pressing and heating the printed image without the figure in a digital printing technology by means of sublimation colors against the web, such that the sublimation colors are absorbed by receptive areas on the one side of the web and form the printed image on the one side of the web, wherein the materials formed by the second ribbon material and not interacting with the sublimation colors come into contact with the sublimation colors but do not absorb the sublimation colors, so that the color of the figure on the web remains unchanged.

2. The method according to claim 1, wherein, when manufacturing a web, the figure protrudes relief-like from one side of the web, and wherein the figure relief, in spite of the applied sublimation colors, does not absorb the sublimation colors from the printed image, but transfers the colors to adjacent areas of the web.

3. The method according to claim 1, comprising manufacturing the web as a wide web, further comprising, after transferring a plurality of adjacent printed images by pressure and heat onto the wide web, cutting the wide web into individual ribbons, and separating the ribbons from each other and further processing the ribbons.

4. The method according to claim 1, wherein the web is comprised of a plurality of individual ribbons arranged one next to another so as to form an articulated web, transferring a plurality of adjacent printed images together by means of pressure and heat onto the articulated web.

5. The method according to claim 1, comprising initially applying the printed image using a digital printing technology with sublimation colors on an intermediate carrier in a mirror-inverted manner, and finally pressing and heating the intermediate carrier with the side thereof with the sublimation colors against the web, such that the printed image is formed on the web.

6. The method according to claim 1, wherein at least one of the first ribbon material and the second material is an elastic material.

7. The method according to claim 1, wherein at least one of the first ribbon material and the second material is an inelastic material.

8. The method according to claim 1, wherein the web is a label ribbon, comprising, after transferring the printed image onto the label web, cutting the label web into individual labels, and separating and processing the labels.

9. The method according to claim 1, comprising producing the figure with textile threads.

10. The method according to claim 9, comprising manufacturing the web by weaving technology and producing the figure by one or more figure warp threads or by figure weft threads.

11. The method according to claim 10, wherein the figure warp threads or the figure weft threads produced the figure as a relief which protrudes above the one side of the web.

12. The method according to claim 11, wherein the figure warp threads are natural fibers or regenerated cellulose fibers.

13. The method according to claim 11, wherein the figure warp threads are of viscose or acetate.

14. The method according to claim 11, wherein the figure weft threads are reflector threads.

15. The method according to claim 1, wherein the web has at least one side with a different thickness.

16. The method according to claim 15, wherein webs having different thicknesses are used as waistbands for trousers or skirts, wherein the ribbon is provided over portions thereof and on one side with the sublimation colors of digital printing.

17. The method according to claim 1, comprising providing the web on a visible side thereof with a layer of loops of a loop-and-hook-type closure; deforming the loop layer over portions thereof by heat and pressure, so that at these locations areas are produced which absorb the printed image, and subjecting an intermediate product to digital printing technology, so that the deformed areas absorb the printed image.

* * * * *